US009300048B2

(12) United States Patent
Mookiah et al.

(10) Patent No.: US 9,300,048 B2
(45) **Date of Patent: *Mar. 29, 2016**

(54) BI-DIRECTIONAL MAGNETIC PERMEABILITY ENHANCED METAMATERIAL (MPEM) SUBSTRATE FOR ANTENNA MINIATURIZATION

(71) Applicant: Drexel University, Philadelphia, PA (US)

(72) Inventors: Prathaban Mookiah, San Diego, CA (US); Kapil Dandekar, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/698,413

(22) Filed: Apr. 28, 2015

(65) Prior Publication Data

US 2015/0244073 A1 Aug. 27, 2015

Related U.S. Application Data

(63) Continuation of application No. 13/805,532, filed as application No. PCT/US2011/041817 on Jun. 24, 2011, now Pat. No. 9,035,831.

(60) Provisional application No. 61/358,750, filed on Jun. 25, 2010, provisional application No. 61/358,756, filed on Jun. 25, 2010.

(51) Int. Cl.

| | |
|---|---|
| ***H01Q 1/36*** | (2006.01) |
| ***H01Q 1/38*** | (2006.01) |
| ***H01Q 7/06*** | (2006.01) |

(Continued)

(52) U.S. Cl.

CPC ..... *H01Q 7/06* (2013.01); *H01Q 13/00* (2013.01); *H01Q 15/0053* (2013.01)

(58) Field of Classification Search

USPC ..... 343/700 MS, 788, 866, 867, 895

See application file for complete search history.

(56) References Cited

U.S. PATENT DOCUMENTS

| | | | |
|---|---|---|---|
| 5,442,366 | A | 8/1995 | Sanford |
| 6,344,824 | B1 | 2/2002 | Takasugi et al. |
| 6,933,812 | B2 | 8/2005 | Sarabandi et al. |

(Continued)

FOREIGN PATENT DOCUMENTS

| | | |
|---|---|---|
| WO | WO 2010/065555 | 6/2010 |

OTHER PUBLICATIONS

Buell et al., "A Substrate for Small Patch Antennas Providing Tunable Miniaturization Factors," IEEE Transactions on Microwave Theory and Techniques, Jan. 2006, 54(1), 135-146.

(Continued)

*Primary Examiner* — Tan Ho

(74) *Attorney, Agent, or Firm* — Baker & Hostetler LLP

(57) ABSTRACT

A bi-directional antenna includes a plurality of unit cells stacked in two perpendicular planes (Y-X and Z-X planes) to form cube shaped unit cells whereby inductive loops are placed on four faces corresponding to the Y-X and Z-X planes. Each unit cell includes a magnetic permeability enhanced metamaterial. The resulting antenna has the ability to couple magnetic fields oriented in both the X and Y directions with increased permeabilities and can be used to realize a variety of different antenna architectures that do not have their magnetic field confined in a single direction.

8 Claims, 2 Drawing Sheets

(51) Int. Cl.
*H01Q 15/00* (2006.01)
*H01Q 13/00* (2006.01)

(56) References Cited

U.S. PATENT DOCUMENTS 7,623,075 B2 11/2009 Apostolos
8,193,996 B2 6/2012 Wu et al.
9,035,831 B2 * 5/2015 Mookiah et al. ..... 343/700 MS
2007/0030207 A1 2/2007 Ibi et al.
2010/0277390 A1 11/2010 Lee et al.

OTHER PUBLICATIONS

International Patent Application No. PCT/US2011/041817: International Search Report and Written Opinion dated Nov. 29, 2011, 10 pages.

* cited by examiner

BI-DIRECTIONAL MAGNETIC PERMEABILITY ENHANCED METAMATERIAL (MPEM) SUBSTRATE FOR ANTENNA MINIATURIZATION

RELATED APPLICATIONS

The present application is a continuation application of U.S. patent application Ser. No. 13/805,532, filed Mar. 18, 2013, which is a national phase application of PCT/US2011/041817, filed Jun. 24, 2011, which, in turn, claims the benefit of U.S. Provisional Patent Application Nos. 61/358,750, filed Jun. 25, 2010, and 61/358,756, filed Jun. 25, 2010. The entireties of these disclosures are incorporated herein by reference for any and all purposes. The present application is also related by subject matter to the invention described in PCT/US2009/066280 by the same inventors and assignee.

STATEMENT OF FEDERALLY SPONSORED RESEARCH

Portions of the disclosure herein may have been supported in part by grants from the National Science Foundation, Grant Nos. CNS-0322795 and ECS-0524200. The United States Government may have certain rights in the invention.

TECHNICAL FIELD

The present invention relates generally to the field of MIMO antenna systems. Specifically, the present invention relates to MIMO antenna arrays built on metamaterial substrates and to related antenna designs for wireless equipment and microwave devices.

BACKGROUND

Wireless communication systems have become pervasive and ubiquitous to the point where data rate and quality of service requirements have become comparable to those of wired communication systems. Next generation wireless systems incorporate multiple-input multiple-output (MIMO) techniques to achieve their performance goals. MIMO systems promise higher channel capacities compared to single antenna systems by exploiting the spatial characteristics of the multipath wireless propagation channel. The theoretical performance gain achievable by MIMO systems is limited due to a number of practical design factors, including the design of the antenna array and the amount of inter-array element mutual coupling. While mutual coupling can be alleviated by increasing the spacing between array elements, accommodating multiple antennas with large spacing in modern consumer devices may be impossible due to stringent space constraints. In order to meet such demanding, and often contradictory, design criteria, antenna designers have been constantly driven to seek better materials on which to build antenna systems.

As disclosed in U.S. Pat. No. 6,933,812, metamaterials are a broad class of synthetic materials that could be engineered to wield permittivity and permeability characteristics to system requirements. It has been theorized that by embedding specific structures (usually periodic structures) in some host media (usually a dielectric substrate), the resulting material can be tailored to exhibit desirable characteristics. These materials have drawn a lot of interest recently due to their promise to miniaturize antennas by a significant factor while operating at acceptable efficiencies.

Metamaterials having permeabilities and permittivities greater than that of a host dielectric have been used to design miniaturized patch antennas. For example, Buell, Mosallaei, and Sarabandi disclose such patch antennas in an article entitled "A Substrate for Small Patch Antennas Providing Tunable Miniaturization Factors," IEEE Transactions on Microwave Theory and Techniques, Vol. 54, No. 1, January 2006. Buell et al. describe a metamaterial spiral loop unit cell that achieves permeability enhancement by aligning the magnetic field along the axis perpendicular to the spiral loop unit cell. Buell et al. further teach that a two-dimensional array of resonant spirals may be formed and the resulting substrate layers stacked to form a three-dimensional effective medium that approximates an infinite magnetic medium. Permittivity enhancement only occurs for electric fields directed in the two-dimensional plane of the spiral loop unit cell. Thus, the patch antenna described by Buell exhibits orientation-dependent permeability and permittivity at orientations that may support the modes of a microstrip patch antenna.

Though such magnetic permeability enhanced metamaterial (MPEM) substrates used for antenna miniaturization do reduce the size of the antenna, they are mostly considered unsuitable for many devices due to the accompanying increase in the substrate thickness. Also, magnetic permeability enhancement in known implementations of magnetic permeability enhanced metamaterial (MPEM) substrates are uni-directional. This is due to the uni-directional alignment of the unit cells. Only magnetic fields that are oriented in a direction perpendicular to the plane of the unit cells couple energy to them. This imposes the limitation that only antenna designs that generate uni-directional magnetic fields can fully utilize the permeability enhancement provided by the substrate, thus seriously limiting the utility of the substrate.

A multi-directional substrate is desirable that provides multi-directional permeability enhancement at a given frequency in the substrate without being restricted to a unique solution. In particular, a substrate that allows the substrate designer to pick dimensions that are more suitable for the target platform is desired.

SUMMARY

By leveraging current micro-fabrication technologies, techniques are provided that can yield a thin MPEM substrate suitable for use in many space constrained devices. The homogeneity of the MPEM substrate of the invention is a function of the number of unit cells in the substrate. The size of the unit cell also imposes a limit on the number of unit cells that can be included in the resulting MPEM substrates. This affects the homogeneity of the material in terms of permittivity and permeability, which results in non-linear field effects within the substrate that may result in poor bandwidth properties. The MPEM substrate in accordance with the invention allows the designer to pick unit cell dimensions that allow for an inclusion of a larger number of unit cells within a given material volume thus achieving greater homogeneity. The resulting substrate will give the antenna array designer a higher degree of analytical fidelity. The substrate of the invention further allows antenna designers to use methods developed for conventional substrates to predict and design antennas instead of relying on time consuming and computationally expensive simulations. The same dimension selection technique can be applied to pick the unit cell configuration that has the ability to reduce the amount of metal in the unit cells that can lead to lower ohmic losses, which results in a more efficient substrate.

In an exemplary embodiment of the invention, the unit cells are stacked in two perpendicular planes (Y-X and Z-X planes) to form a bi-directional MPEM substrate that achieves bi-directional permeability enhancement. Unlike the planar unit cell layout employed in existing MPEM substrates, the bi-directional MPEM substrate of the invention uses cube shaped unit cells where the inductive loops are placed on four faces corresponding to the Y-X and Z-X planes. This structure provides the ability to couple magnetic fields oriented in both the X and Y directions. The resulting material can be used to realize a variety of different antenna architectures that do not have their magnetic field confined in a single direction.

DETAILED DESCRIPTION OF ILLUSTRATIVE EMBODIMENTS

A detailed description of illustrative embodiments of the present invention will now be described with reference to FIGS. 1-3. Although this description provides a detailed example of possible implementations of the present invention, it should be noted that these details are intended to be exemplary and in no way delimit the scope of the invention.

Magnetic permeability enhanced metamaterials are constructed by stacking up unit cells that can store magnetic energy by virtue of their structure. A unit cell for the material used in embodiments of the invention contains an inductive spiral loop embedded in a host dielectric material. Magnetic energy storage is created in the unit cell when a magnetic field passes normal to the plane of the spiral, inducing a current in the loop. This phenomenon effectively creates an inductance within the host substrate material. The material is formed by arranging these unit cells in three dimensions as will be described in more detail below. A resonance behavior is generated at frequencies dictated by the inductance of the loop and capacitances that exist between adjacent arms in the loop. Thus, at resonance, a significant net magnetic energy storage is induced within the 3D structure and the magnetic permeability of the otherwise non-magnetic substrate material is enhanced. In order to realize a miniaturized antenna, it is therefore necessary to match the resonance frequency of the material and the antenna. The resonance frequency of this structure can be controlled by tuning the spiral and substrate dimensions.

Figure 1:
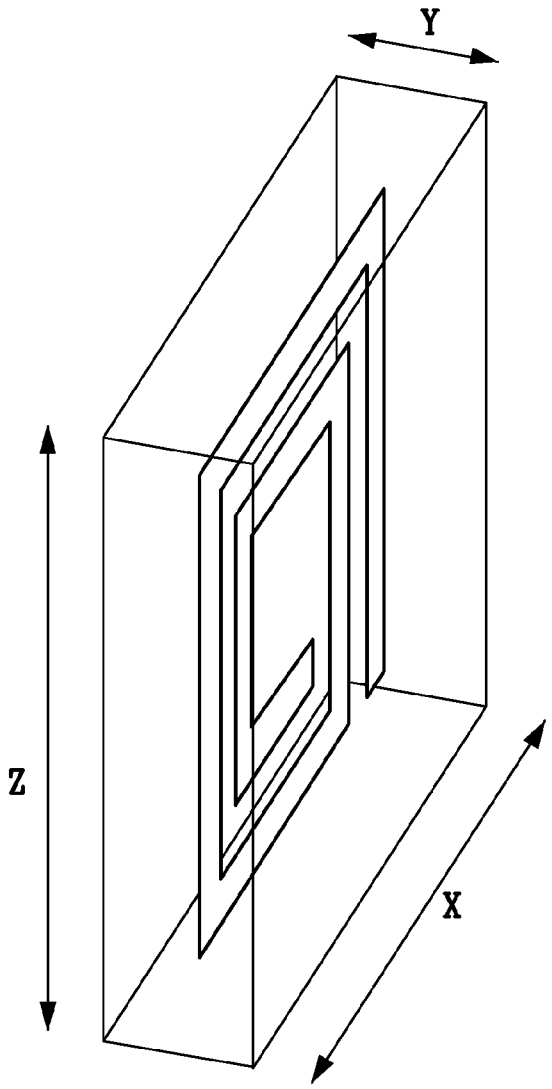
FIG. 1 shows one embodiment of a unit cell structure for an antenna designed in accordance with the invention.
Figure 2:
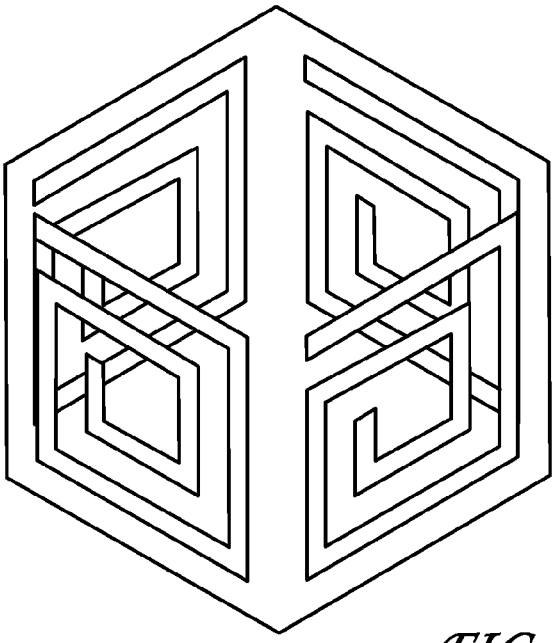
FIG. 2 shows an embodiment of a cube shaped unit cell structure in accordance with the invention.

A unit cell structure designed to resonate in the 2.48 GHz band is shown in FIG. 1 along with its dimensions. FR4 ($c_r$=4.4, $\mu_r$=1, loss tangent tan $\delta$=0.02) is used as the host material for the metamaterial substrate in an exemplary embodiment. The effective $\mu_r$ was found to be approximately 4.2 in the direction perpendicular to the plane of the unit cell. This substrate also experiences an enhancement in permittivity due to its geometry. The extracted effective $c_r$ was 9.7 and the resulting electric and magnetic tan $\delta$ are 0.2 and 0.05. These values imply a lossy substrate leading to poor antenna efficiencies.

The antenna geometry embodying exemplary embodiments of the invention is a rectangular patch antenna with a recessed microstrip feed line, backed by a ground plane and operating in the $TM_{010}$ mode built on the magnetic permeability enhanced metamaterial substrate. TM refers to the transverse mode of the electromagnetic radiation. FR4 was chosen as the host material in the magnetic permeability enhanced substrate as well as the conventional substrate used for comparison.

Current is induced in the spiral loop only by magnetic fields oriented in a direction perpendicular to the plane of the spiral. Hence, magnetic permeability enhancement is unidirectional in the substrate. Since the magnetic field in the near field of a rectangular patch antenna would be in a direction perpendicular to its radiating edge, this antenna design can fully utilize the permeability available in this direction. The substrate and the antenna were designed to resonate at 2.48 GHz. The effective $\mu_r$ derived theoretically for this structure is approximately 3.7 in the direction perpendicular to the plane of the unit cell.

The MPEM substrate of FIG. 1, for example, is designed using low loss commercially available host materials for a wide range of frequencies. The designed MPEM substrate designs can be made using micro-fabrication facilities and can be bonded together to form sturdy 3D structures. These MPEM substrates can then be evaluated through a wide range of antenna designs for its miniaturization capabilities, bandwidth enhancement and efficiency. Such an MPEM substrate allows the antennas to be significantly thinner, making them a candidate for inclusion in more space constrained devices such as mobile phones. The material will be more homogeneous in terms of electromagnetic properties than existing designs that allows for improved device properties in terms of bandwidth and matching. The homogeneous property of the MPEM substrate also will allow a design engineer to analytically design and predict the performance of antennas and other devices without having to resort to more time consuming simulation methods. Moreover, it will be appreciated by those skilled in the art that the antennas and other devices formed from such unit cells will be more efficient due to the lower amount of metal in the unit cells.

Table 1 shows different unit cell dimensions and realized permeability at 2.48 GHz for unit configurations that yield a substrate thickness less than or equal to 1.5 mm.

TABLE 1

Different Unit Cell Dimensions and Realized Permeability at 2.48 GHz for Unit Configurations that Yield a Substrate Thickness less than or equal to 1.5mm

| X (mm) | Y (mm) | Z (mm) | Cell Volume ($mm^3$) | $\mu_r$ |
|---|---|---|---|---|
| 11.4 | 1.5 | 0.6 | 10.3 | 14.0 |
| 10.8 | 1.5 | 0.9 | 14.6 | 7.3 |
| 11.4 | 1.5 | 0.9 | 15.4 | 1.0 |
| 10.8 | 3.0 | 0.9 | 29.2 | 11.2 |
| 10.8 | 1.5 | 1.2 | 19.4 | 10.4 |
| 11.4 | 1.5 | 1.2 | 20.5 | 3.3 |
| 12.0 | 1.5 | 1.2 | 21.6 | 3.3 |
| 10.8 | 3.0 | 1.2 | 38.9 | 2.6 |
| 10.8 | 4.5 | 1.2 | 58.3 | 2.6 |
| 10.8 | 6.0 | 1.2 | 77.8 | 14.2 |
| 10.8 | 1.5 | 1.5 | 24.3 | 8.2 |
| 11.4 | 1.5 | 1.5 | 25.7 | 7.0 |
| 12.0 | 1.5 | 1.5 | 27.0 | 6.4 |
| 10.2 | 3.0 | 1.5 | 45.9 | 6.2 |
| 10.8 | 3.0 | 1.5 | 48.6 | 1.0 |

The aforementioned PCT/US2009/066280 describes a rectangular patch antenna array including such unit cells mounted on a substrate such that the rectangular inductive spiral loops are embedded uniformly and uni-directionally within a host dielectric substrate to form a magnetic permeability enhanced metamaterial. The unit cells are uniformly stacked on each other to form a three-dimensional resonance structure that is oriented orthogonally to a magnetic field of the antennas. Dimensions of the rectangular inductive spiral loops are selected whereby the metamaterial has a resonance frequency that matches a resonance frequency of the antennas. The dimensions of the rectangular inductive spiral loops of the unit cells may be tuned whereby the resonance frequency of the metamaterial matches the resonance frequency of the antenna. Each unit cell is spaced from each other unit cell by a spacing of $\lambda/2$ or $\lambda/20$ in an azimuthal plane of the substrate, where $\lambda=c/f$, where c is the speed of light and f is the resonance frequency of the substrate. The rectangular inductive spiral loops of each unit cell have the same dimensions and same resonance frequency. However, as noted above, with such an arrangement, only magnetic fields that are oriented in a direction perpendicular to the plane of the unit cells couple energy to them. This imposes the limitation that only antenna designs that generate uni-directional magnetic fields can fully utilize the permeability enhancement provided by the substrate, seriously limiting the utility of the substrate.

Unlike such a substrate formed by stacking the unit cells of FIG. 1 uniformly on each other to form a three-dimensional resonance structure that is oriented orthogonally to a magnetic field of the antennas, the unit cell structure of the invention includes a plurality of unit cells that are stacked in two perpendicular planes (Y-X and Z-X planes) to form cube shaped unit cells where the inductive loops are placed on four faces corresponding to the Y-X and Z-X planes. FIG. 2 shows an embodiment of such a three-dimensional unit cell structure in accordance with the invention, while FIG. 3 shows an embodiment of a three-dimensional MPEM substrate in accordance with the invention formed from a plurality of the cube shaped unit cells of FIG. 2. A desired antenna design may be formed by configuring a plurality of such cube shaped unit cells in a desired configuration and bonding the cube shaped unit cell structures together to form sturdy 3D structures having the desired transmission characteristics. The resulting antenna has the ability to couple magnetic fields oriented in both the X and Y directions with increased permeabilities. It will be appreciated by those skilled in the art that the resulting material can be used to realize a variety of different antenna architectures that do not have their magnetic field confined in a single direction.

Figure 3:
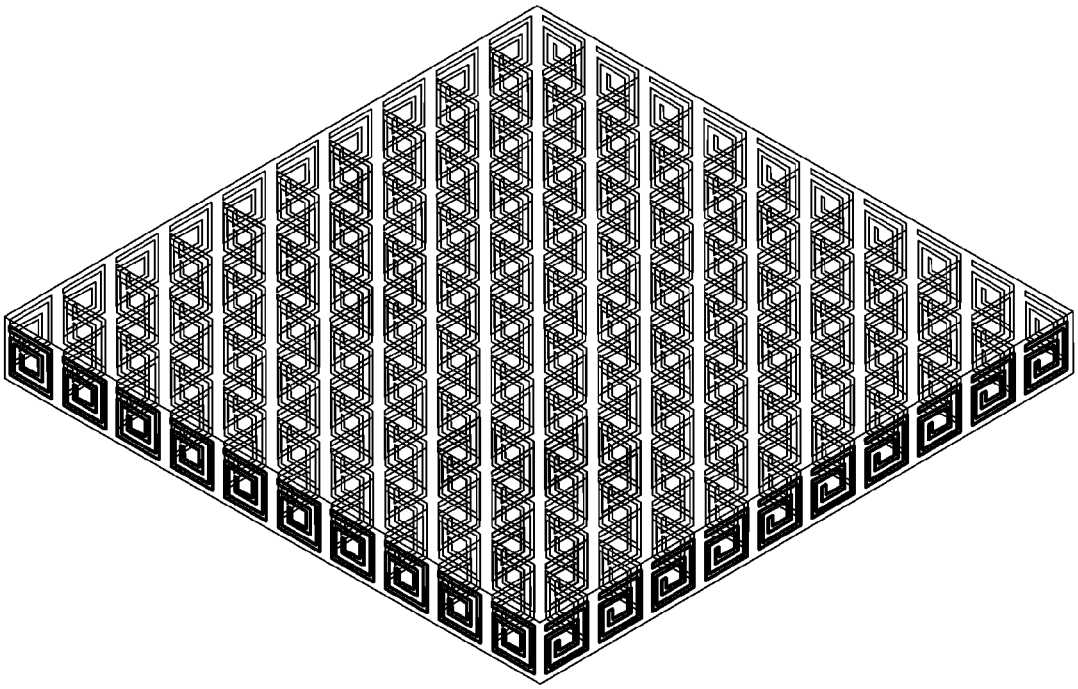
FIG. 3 shows an embodiment of a three-dimensional MPEM substrate in accordance with the invention formed from a plurality of the cube shaped unit cell structures of FIG. 2.

In one embodiment of the invention, the MPEM substrate of FIG. 3 couples magnetic fields oriented in both X and Y directions which results in magnetic permeability enhancement in two directions compared to existing designs that yield only uni-directional enhancement. The design gives antenna engineers greater flexibility in applying the MPEM substrates for designing different antenna architectures where the fields are not confined to a single plane. Preferably, the bi-directional MPEM substrate of FIG. 3 can be designed using low loss commercially available host materials for a wide range of frequencies. The resulting MPEM substrate may be tried in different configurations of antenna designs for its miniaturization capabilities.

Those skilled in the art also will readily appreciate that many additional modifications are possible in the exemplary embodiment without materially departing from the novel teachings and advantages of the invention. For example, while the inductive loops of the exemplary unit cells include rectangular inductive spiral loops embedded uniformly and uni-directionally within a host dielectric substrate to form magnetic permeability enhanced metamaterial, those skilled in the art will appreciate that other inductive loop designs may be used without departing from the teachings of the invention. For example, the inductive loops and unit cells need not be shaped as squares and the cube shaped unit cells need not be cubes having sides of equal dimensions. The unit square may comprise rectangular substrates with embedded rectangular inductive spiral loops and the cubes may have rectangular sides with different dimensions. Accordingly, any such modifications are intended to be included within the scope of this invention as defined by the following exemplary claims.

What is claimed:

1. A bi-directional antenna comprising a plurality of unit cells stacked in two perpendicular planes to form a unit cell, each unit cell comprising a magnetic permeability enhanced metamaterial formed into an inductive loop in a substrate and each unit cell forming a face of the three-dimensional unit cell whereby inductive loops of respective unit cells are situated on four perpendicular faces of said three-dimensional unit cell formed by said two perpendicular planes.

2. A bi-directional antenna as in claim 1, wherein a thickness of the substrate in each three-dimensional unit cell is less than or equal to 1.5 mm.

3. A bi-directional antenna comprising a plurality of the three-dimensional unit cells of claim 1 bonded together to form a three-dimensional antenna structure having desired transmission characteristics.

4. A bi-directional antenna as in claim 3, wherein said inductive loops comprise rectangular inductive spiral loops embedded uniformly and uni-directionally within a host dielectric substrate so as to form said magnetic permeability enhanced metamaterial.

5. A bi-directional antenna as in claim 4, wherein dimensions of said rectangular inductive spiral loops are selected whereby said metamaterial has a resonance frequency that matches a resonance frequency of said antennas.

6. A bi-directional antenna as in claim 4, wherein the rectangular inductive spiral loops of each three-dimensional unit cell have the same dimensions and same resonance frequency.

7. A bi-directional antenna as in claim 3, wherein the unit cells are uniformly stacked on each other to form a three-dimensional resonance structure that is oriented orthogonally to a magnetic field of the antenna.

8. A bi-directional antenna as in claim 1, wherein each substrate and each inductive loop is rectangular in shape.

* * * * *